US012130044B2

(12) United States Patent
Kojima

(10) Patent No.: US 12,130,044 B2
(45) Date of Patent: Oct. 29, 2024

(54) AIR CONDITIONING APPARATUS

(71) Applicant: DAIKIN INDUSTRIES, LTD., Osaka (JP)

(72) Inventor: Makoto Kojima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 467 days.

(21) Appl. No.: 17/435,900

(22) PCT Filed: Feb. 20, 2020

(86) PCT No.: PCT/JP2020/006861
§ 371 (c)(1),
(2) Date: Mar. 14, 2022

(87) PCT Pub. No.: WO2020/179481
PCT Pub. Date: Sep. 10, 2020

(65) Prior Publication Data

US 2022/0243952 A1 Aug. 4, 2022

(30) Foreign Application Priority Data

Mar. 5, 2019 (JP) ..... 2019-039346

(51) Int. Cl.
*F24F 13/22* (2006.01)
*F24F 1/0063* (2019.01)
(Continued)

(52) U.S. Cl.
CPC ..... *F24F 13/22* (2013.01); *F24F 1/0063* (2019.02); *F24F 1/0068* (2019.02);
(Continued)

(58) Field of Classification Search
CPC ..... F24F 1/0063; F24F 1/0068; F24F 13/22; F24F 2013/221; F25B 2500/222
See application file for complete search history.

(56) References Cited

U.S. PATENT DOCUMENTS

2017/0328580 A1* 11/2017 Furuta ..... F24F 1/0047
2018/0094844 A1 4/2018 Suzuki

FOREIGN PATENT DOCUMENTS

JP 201364525 A 4/2013
JP 2014-215010 A 11/2014
(Continued)

OTHER PUBLICATIONS

International Preliminary Report on Patentability issued for PCT/JP2020/006861, issued Sep. 16, 2021 (10 pages).
(Continued)

*Primary Examiner* — Jonathan Bradford
(74) *Attorney, Agent, or Firm* — Osha Bergman Watanabe & Burton LLP

(57) ABSTRACT

An object is to provide an air conditioning apparatus in which, even when a refrigerant leaks outside a casing, the leaked refrigerant is easily guided to the inside of the casing. In an indoor unit (3) of an air conditioning apparatus (1) that includes a casing (30) having an opening (64*a*), an indoor heat exchanger (51) disposed in the casing (30), a liquid-side connection pipe (53) or a gas-side connection pipe (54) extending from the indoor heat exchanger (51) to the outside of the casing (30) through the opening (64*a*), and an indoor-side dew condensation prevention member (71) that covers the periphery of the liquid-side connection pipe (53) or the gas-side connection pipe (54), an end portion of the liquid-side connection pipe (53) or the gas-side connection pipe (54) is used in a state of being covered from the periphery thereof by a connection-side dew condensation prevention member (72) or is covered from the periphery thereof by the indoor-side dew condensation prevention member (71), and there is formed a communication passage (91) that causes a space of a part covered by the dew condensation prevention member at the end portion of the liquid-side connection pipe (53) or the gas-side connection
(Continued)

pipe (54) to be in communication with the internal space of the casing (30).

8 Claims, 10 Drawing Sheets

(51) Int. Cl.
*F24F 1/0068* (2019.01)
*F25B 49/00* (2006.01)

(52) U.S. Cl.
CPC ..... *F25B 49/005* (2013.01); *F24F 2013/221* (2013.01); *F25B 2500/222* (2013.01)

(56) References Cited

FOREIGN PATENT DOCUMENTS

| | | | |
|---|---|---|---|
| JP | 2015-230136 | A | 12/2015 |
| JP | 2016-011771 | A | 1/2016 |
| JP | 2016-011772 | A | 1/2016 |
| JP | 2016-197006 | A | 11/2016 |
| JP | 2017-015324 | A | 1/2017 |
| JP | 2018-124009 | A | 8/2018 |
| WO | 2019/138529 | A1 | 7/2019 |

OTHER PUBLICATIONS

International Search Report issued in corresponding International Application No. PCT/JP2020/006861, mailed on Apr. 21, 2020 (5 pages).
Written Opinion issued in corresponding International Application No. PCT/JP2020/006861, mailed on Apr. 21, 2020 (5 pages).
Extended European Search Report issued in corresponding European Patent Application No. EP 20765843.6 dated Mar. 11, 2022 (9 pages).

* cited by examiner

AIR CONDITIONING APPARATUS

TECHNICAL FIELD

The present disclosure relates to an air conditioning apparatus.

BACKGROUND

There is an air conditioning apparatus provided with a gas sensor to grasp, when a leakage of a refrigerant occurs in the air conditioning apparatus, the occurrence of the leakage so that an appropriate measure can be taken. For example, in PTL 1 (Japanese Unexamined Patent Application Publication No. 2016-197006), there is proposed an air conditioning apparatus provided with a gas sensor in the vicinity of an intake opening portion inside a housing of an indoor unit.

However, when a leakage of a refrigerant occurs outside the casing in the existing indoor unit, it may be difficult to grasp the leakage of the refrigerant.

One or more embodiments of the present disclosure provide an air conditioning apparatus in which, even when a refrigerant leaks outside a casing, the leaked refrigerant is easily guided to the inside of the casing.

SUMMARY

An air conditioning apparatus according to one or more embodiments includes a casing, a heat exchanger, a refrigerant pipe, a first dew condensation prevention member (first dew condensation prevention cover), and a communication passage. The casing has a pipe opening. The heat exchanger is disposed in the casing. The refrigerant pipe includes a pipe-connection end portion positioned on the outer side of the casing. The refrigerant pipe extends from the heat exchanger to the pipe-connection end portion through the pipe opening of the casing. The first dew condensation prevention member peripherally covers at least a part passing through the pipe opening of the casing. The part is a portion of the refrigerant pipe. The first dew condensation prevention member is cylindrical. The communication passage causes a first space to be in communication with an internal space of the casing. The first space is a part in which the pipe-connection end portion is covered by a first dew condensation prevention member or a second dew condensation prevention member (second dew condensation prevention cover). The second dew condensation prevention member is a member that differs from the first dew condensation prevention member.

For example, when the air conditioning apparatus includes an outdoor unit and an indoor unit, the air conditioning apparatus here may have the aforementioned configuration only in the indoor unit of the air conditioning apparatus.

The communication passage is not limited. When the pipe-connection end portion is covered by the first dew condensation prevention member, the communication passage may be a communication passage causing a space that is outside the pipe at the pipe-connection end portion and that is on the inner side of the first dew condensation prevention member to be in communication with the internal space of the casing. When the pipe-connection end portion is covered by the second dew condensation prevention member, the communication passage may be a communication passage causing a space that is outside the pipe at the pipe-connection end portion and that is on the inner side of the second dew condensation prevention member to be in communication with the internal space of the casing. When the pipe-connection end portion is covered by the first dew condensation prevention member and the second dew condensation prevention member, the communication passage may be a communication passage causing a space that is outside the pipe at the pipe-connection end portion, that is on the inner side of the first dew condensation prevention member, and that is on the inner side of the second dew condensation prevention member to be in communication with the internal space of the casing.

In the air conditioning apparatus, even if a refrigerant leaks from the pipe-connection end portion or the periphery thereof, the leaked refrigerant is easily guided to the inside of the casing due to the communication passage causing the space of the part covered by the first dew condensation prevention member or the second dew condensation prevention member at the pipe-connection end portion to be in communication with the internal space of the casing.

In an air conditioning apparatus according to one or more embodiments, the communication passage is included between the first dew condensation prevention member and the refrigerant pipe, in the first dew condensation prevention member, or at an outer peripheral portion of the first dew condensation prevention member.

In an air conditioning apparatus according one or more embodiments, the communication passage is constituted by a pipe made of a non-metal.

In the air conditioning apparatus, due to the communication passage constituted by a pipe made of a non-metal, dew condensation does not easily occur in the communication passage.

In an air conditioning apparatus according to one or more embodiments, a tip portion of the pipe on the side of the first space has an obliquely cut shape.

In the air conditioning apparatus, the tip portion of the pipe on the side of the first space is widely open, and thus, it is possible to suppress easy occurrence of blockage.

In an air conditioning apparatus according to one or more embodiments, the communication passage is bonded and fixed to at least one of the refrigerant pipe and the first dew condensation prevention member.

The air conditioning apparatus can suppress coming off of the communication passage from the refrigerant pipe or the first dew condensation prevention member.

An air conditioning apparatus according to one or more embodiments further includes an inside fastening member (inside fastener). The inside fastening member fastens the communication passage, the refrigerant pipe, and the first dew condensation prevention member on the side of the internal space of the casing with respect to the pipe-connection end portion.

In the air conditioning apparatus, it is possible to make the positional relationship among the communication passage, the refrigerant pipe, and the first dew condensation prevention member stable since the communication passage, the refrigerant pipe, and the first dew condensation prevention member are fastened on the side of the internal space of the casing with respect to the pipe-connection end portion by the inside fastening member.

An air conditioning apparatus according to one or more embodiments further includes an outside fastening member (outside fastener). The outside fastening member fastens the first dew condensation prevention member and a pipe that is connected to the pipe-connection end portion and that is in communication with the refrigerant pipe.

In the air conditioning apparatus, the pipe that is connected to the pipe-connection end portion and that is in communication with the refrigerant pipe and the first dew condensation prevention member are fastened by the outside fastening member. Therefore, dew condensation at not only the pipe-connection end portion but also the periphery of a portion connected to a pipe connected to the refrigerant pipe can be also suppressed by the first dew condensation prevention member.

An air conditioning apparatus according to one or more embodiments further includes a refrigerant leakage sensor. The refrigerant leakage sensor is disposed inside the casing. The refrigerant leakage sensor detects a leaked refrigerant.

In the air conditioning apparatus, even when a refrigerant leakage occurs at the pipe-connection end portion or the periphery thereof, the leaked refrigerant that is guided to the inside of the casing through the communication passage can be detected by the refrigerant leakage sensor disposed inside the casing.

In an air conditioning apparatus according to one or more embodiments, a sensor that detects a leaked refrigerant is not provided outside the casing.

In the air conditioning apparatus, even when a sensor that detects a leakage of a refrigerant is not provided outside the casing, a refrigerant leakage that occurs at the pipe-connection end portion or the periphery thereof can be detected.

DETAILED DESCRIPTION (1) Configuration of Air Conditioning Apparatus

Figure 1:
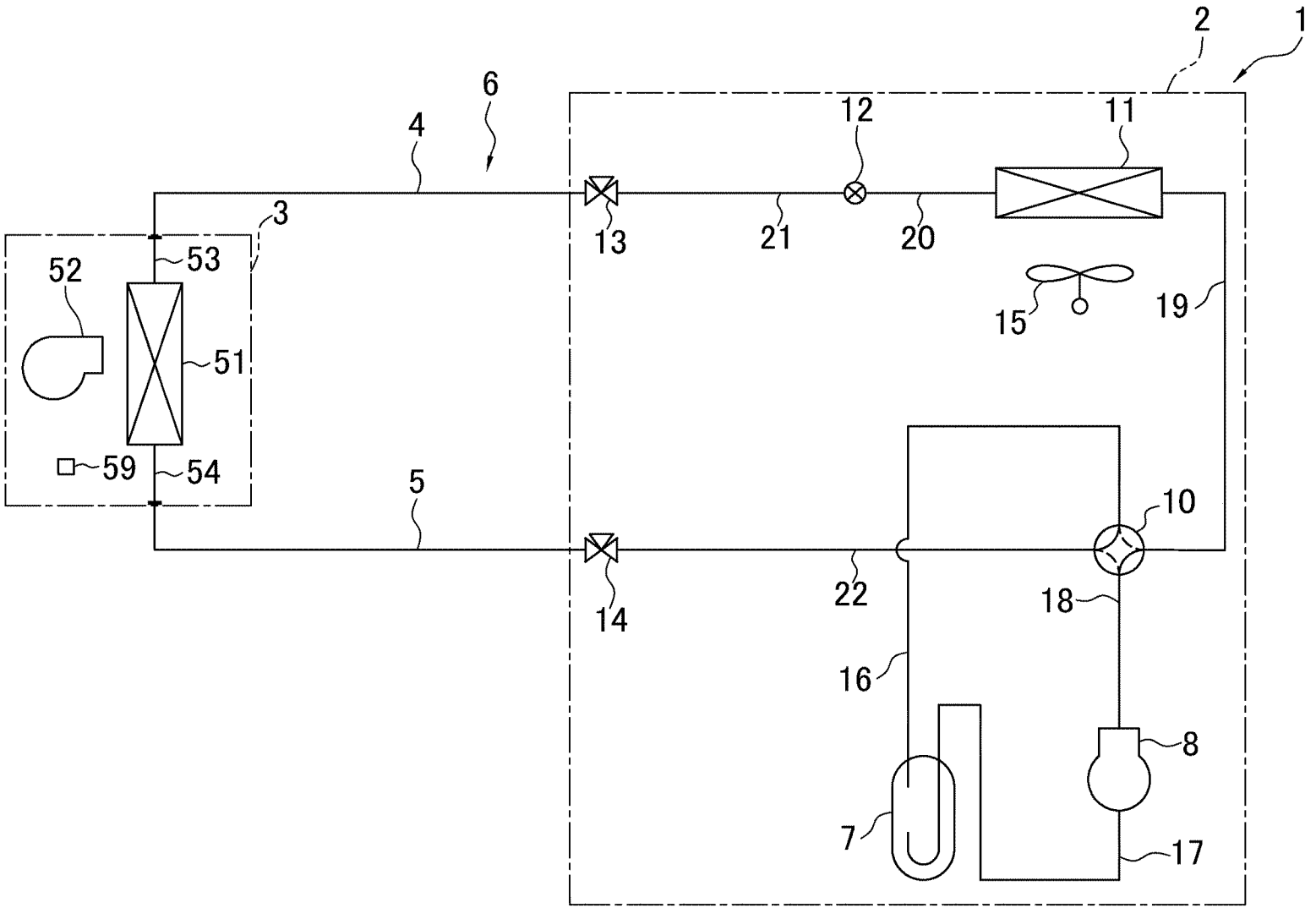
FIG. 1 is a schematic configurational view of an air conditioning apparatus.

In FIG. 1, a schematic configurational view of an air conditioning apparatus 1 is illustrated.

The air conditioning apparatus 1 is an apparatus capable of cooling and heating a room of a building or the like by performing a vapor compression refrigeration cycle.

The air conditioning apparatus 1 includes, mainly, an outdoor unit 2, an indoor unit 3, and a liquid-side refrigerant connection pipe 4 and a gas-side refrigerant connection pipe 5 that are refrigerant paths connecting the outdoor unit 2 and the indoor unit 3 to each other. A vapor compression refrigerant circuit 6 of the air conditioning apparatus 1 is constituted by the outdoor unit 2 and the indoor unit 3 being connected to each other via the refrigerant connection pipes 4 and 5. The refrigerant connection pipes 4 and 5 are refrigerant pipes that are constructed locally during installation of the air conditioning apparatus 1 in an installation location in a building or the like. In one or more embodiments, the refrigerant circuit 6 is packed with R32 as a working refrigerant but is not limited thereto.

(2) Outdoor Unit

The outdoor unit 2 is installed outdoor (on the rooftop of a building, in the vicinity of a wall surface of a building, or the like) and constitutes a portion of the refrigerant circuit 6. The outdoor unit 2 includes, mainly, an accumulator 7, a compressor 8, a four-way switching valve 10, an outdoor heat exchanger 11, an outdoor expansion valve 12 as an expansion mechanism, a liquid-side shutoff valve 13, a gas-side shutoff valve 14, and an outdoor fan 15.

The accumulator 7 is a container for supplying a gas refrigerant to the compressor and is provided on the suction side of the compressor 8.

The compressor 8 sucks and compresses a low-pressure gas refrigerant and discharges a high-pressure gas refrigerant.

The outdoor heat exchanger 11 is a heat exchanger that functions during a cooling operation as a radiator or a condenser for a refrigerant discharged from the compressor 8 and that functions during a heating operation as an evaporator for a refrigerant sent from an indoor heat exchanger 51. The outdoor heat exchanger 11 is connected at the liquid side thereof to the outdoor expansion valve 12 and connected at the gas side thereof to the four-way switching valve 10.

The outdoor expansion valve 12 is an electric expansion valve capable of, during a cooling operation, decompressing a refrigerant whose heat is radiated in the outdoor heat exchanger 11 before sending the refrigerant to the indoor heat exchanger 51 and, during a heating operation, decompressing a refrigerant whose heat is radiated in the indoor heat exchanger 51 before sending the refrigerant to the outdoor heat exchanger 11.

One end of the liquid-side refrigerant connection pipe 4 is connected to the liquid-side shutoff valve 13 of the outdoor unit 2. One end of the gas-side refrigerant connection pipe 5 is connected to the gas-side shutoff valve 14 of the outdoor unit 2.

Devices of the outdoor unit 2 and the valves are connected to each other by pipes 16 to 22.

The four-way switching valve 10 switches between a connection state for a cooling operation and a connection state for a heating operation, which will be described later, by switching between a state (refer to the solid lines in the four-way switching valve 10 in FIG. 1) in which the discharge side of the compressor 8 is connected to the side of the outdoor heat exchanger 11 and in which the suction side of the compressor 8 is connected to the side of the gas-side shutoff valve 14 and a state (refer to the dashed lines in the four-way switching valve 10 in FIG. 1) in which the discharge side of the compressor 8 is connected to the side of the gas-side shutoff valve 14 and in which the suction side of the compressor 8 is connected to the side of the outdoor heat exchanger 11.

The outdoor fan 15 is disposed inside the outdoor unit 2 and, after taking outdoor air therein and supplying the outdoor air to the outdoor heat exchanger 11, forms an airflow that is discharged to the outside of the unit. As above, the outdoor air supplied by the outdoor fan 15 is used as a cooling source or a heating source in a heat exchange with the refrigerant of the outdoor heat exchanger 11.

(3) Indoor Unit (3-1) General Configuration of Indoor Unit

Figure 2:
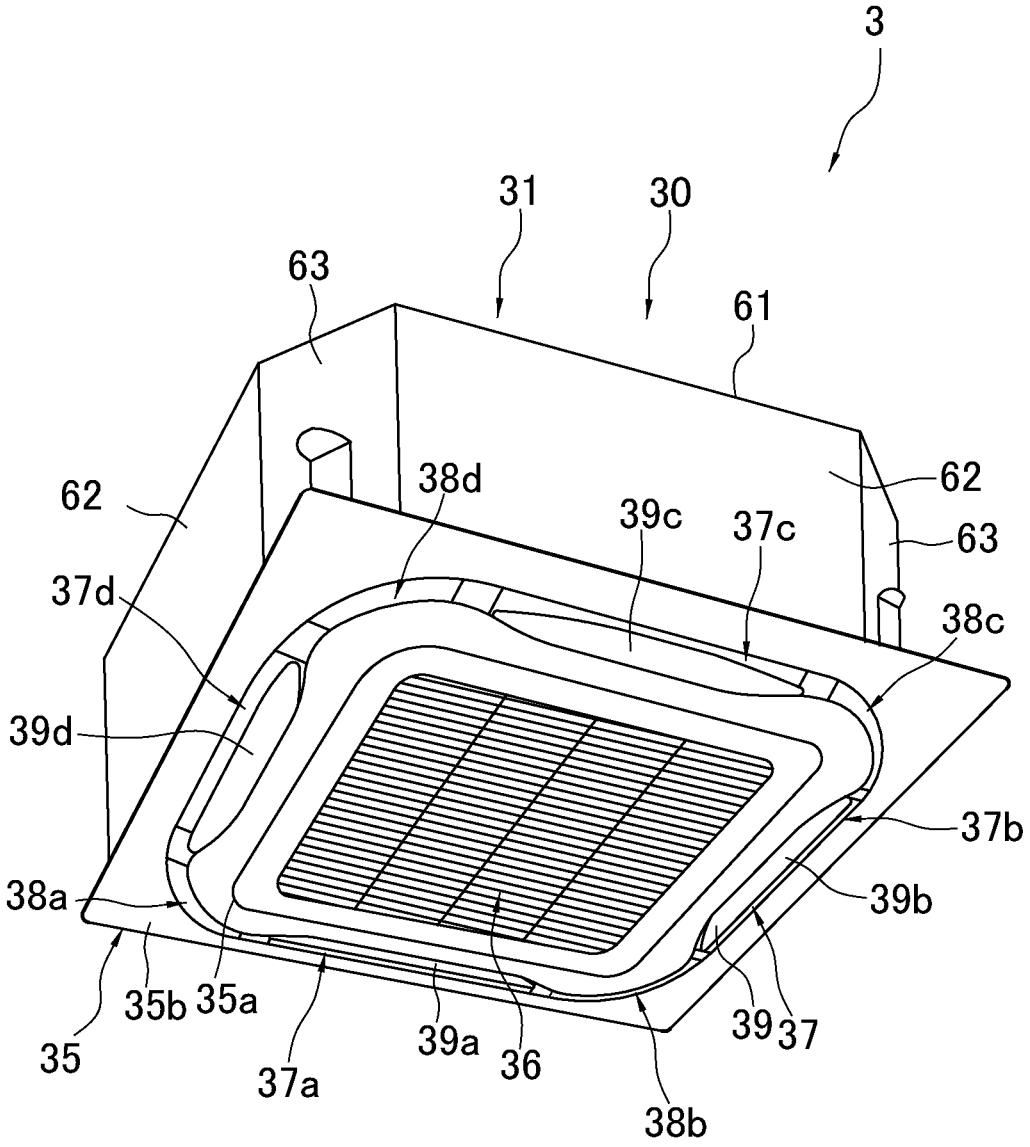
FIG. 2 is a schematic external perspective view of an indoor unit.
Figure 3:
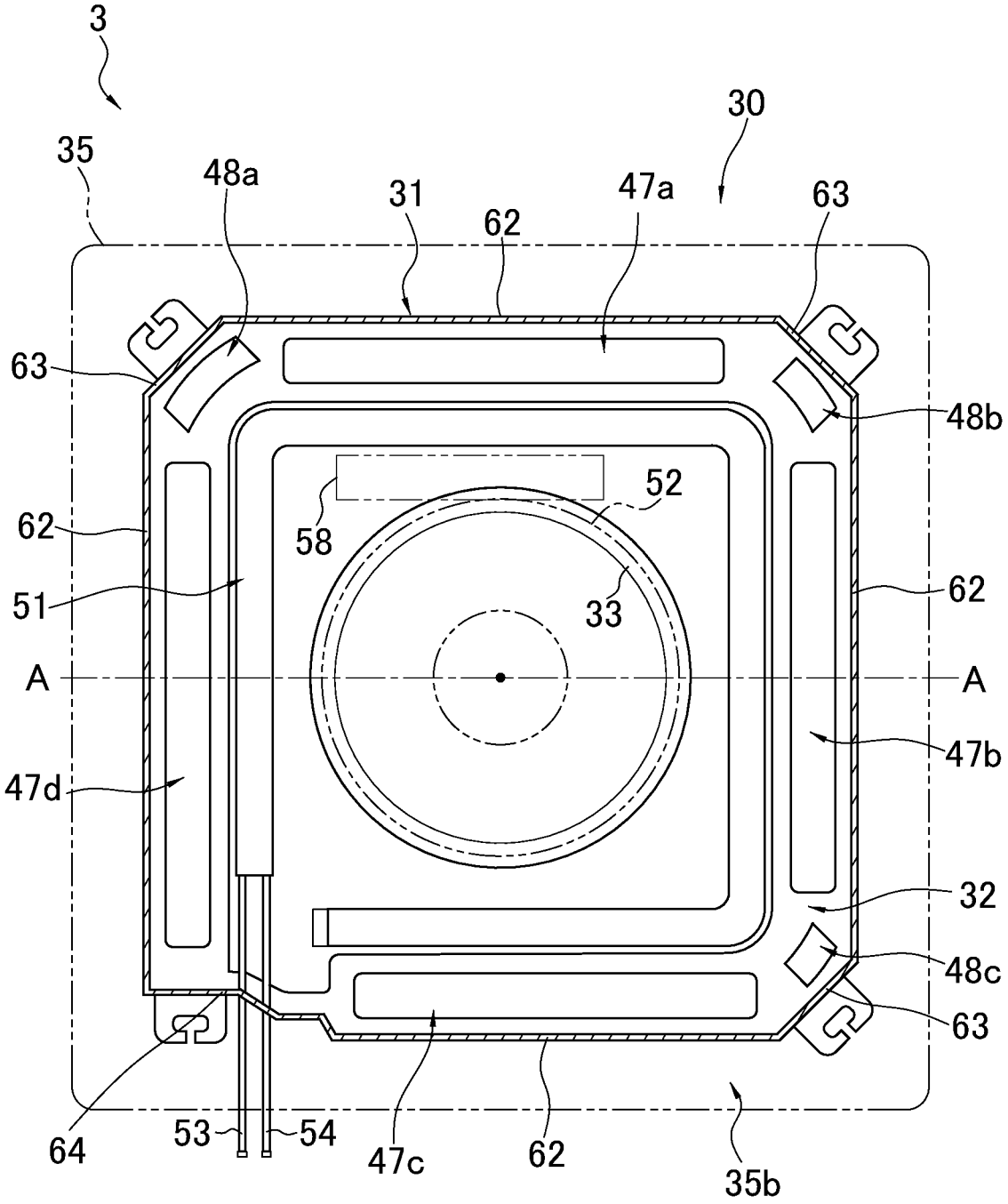
FIG. 3 is a schematic configurational plan view of an indoor unit.
Figure 4:
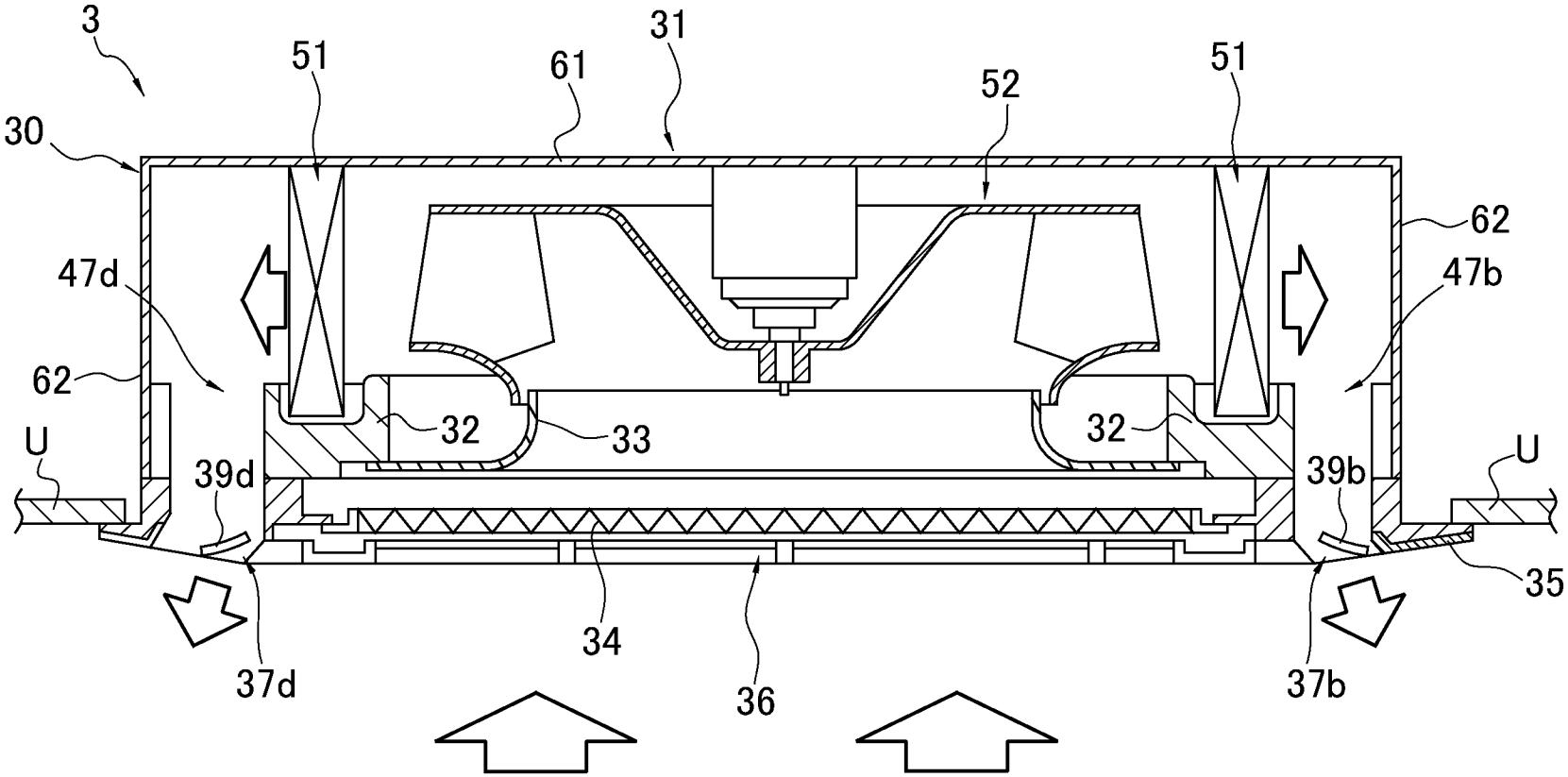
FIG. 4 is a schematic configurational side view of an indoor unit in the A-A section in FIG. 3.

In FIG. 2, an external perspective view of the indoor unit 3 is illustrated. In FIG. 3, a schematic plan view of the indoor unit 3 in a state in which the top panel thereof is removed is illustrated. In FIG. 4, a schematic side sectional view of the indoor unit 3 in a section indicated by A-A in FIG. 3 is illustrated.

In one or more embodiments, the indoor unit 3 is an indoor unit of a type that is installed by being embedded in an opening provided in a ceiling of a room or the like that is an air-conditioning target space. The indoor unit 3 constitutes a portion of the refrigerant circuit 6. The indoor unit 3 includes, mainly, the indoor heat exchanger 51, a liquid-side connection pipe 53, a gas-side connection pipe 54, an indoor fan 52, a casing 30, a flap 39, a bell mouth 33, a drain pan 32, an indoor control unit 58, and a refrigerant leakage sensor 59.

The indoor heat exchanger 51 is a heat exchanger that functions during a cooling operation as an evaporator for a refrigerant whose heat is radiated or that is condensed in the outdoor heat exchanger 11 and functions during a heating operation as a radiator or a condenser for a refrigerant discharged from the compressor 8. The indoor heat exchanger 51 is connected at the liquid side thereof with the liquid-side connection pipe 53 and connected at the gas side thereof with the gas-side connection pipe 54. An end portion of the liquid-side connection pipe 53 on a side opposite to the side of the indoor heat exchanger 51 is connected to an indoor-side end portion of the liquid-side refrigerant connection pipe 4. An end portion of the gas-side connection pipe 54 on a side opposite to the side of the indoor heat exchanger 51 is connected to an indoor-side end portion of the gas-side refrigerant connection pipe 5.

Figure 5:
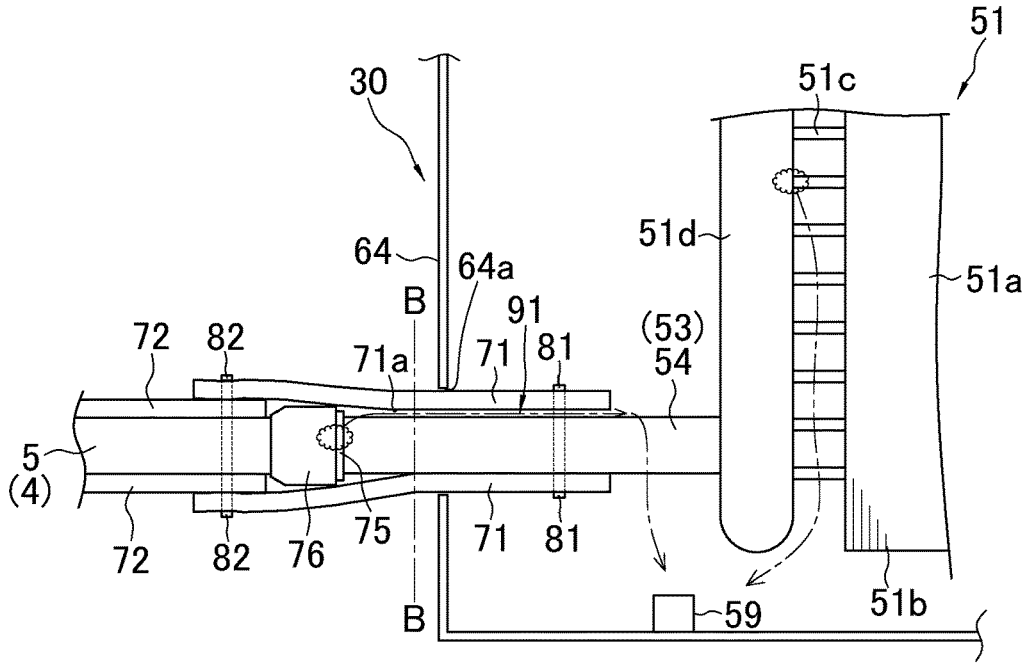
FIG. 5 is a schematic configurational side view illustrating connection between a gas-side connection pipe 54 (liquid-side connection pipe 53) and a gas-side refrigerant connection pipe 5 (liquid-side refrigerant connection pipe 4).

In more detail, as illustrated in FIG. 5, the indoor heat exchanger 51 includes a heat exchanger body 51*a* and a gas-side header 51*d* and includes a flow divider and a plurality of capillary tubes, which are not illustrated. The heat exchanger body 51*a* is configured as a cross-fin tube type heat exchanger including a plurality of fins 51*b* and a plurality of heat transfer pipes 51*c*. The gas-side header 51*d* is connected with the plurality of heat transfer pipes 51*c* and divides or merges a gas refrigerant. The gas-side header 51*d* and the plurality of heat transfer pipes 51*c* are connected and fixed to each other by welding. The gas-side connection pipe 54 connected to the gas-side refrigerant connection pipe 5 and the gas-side header 51*d* are also connected and fixed to each other by welding. The plurality of heat transfer pipes 51*c* are connected to the flow divider via the plurality of capillary tubes. The flow divider is connected with the liquid-side connection pipe 53 connected to the liquid-side refrigerant connection pipe 4. The flow divider and the plurality of capillary tubes are connected and fixed to each other by welding. The plurality of capillary tubes and the plurality of heat transfer pipes 51*c* are also connected and fixed to each other by welding. The flow divider and the liquid-side connection pipe 53 are also further connected and fixed to each other by welding.

The indoor fan 52 is a centrifugal fan disposed inside a casing body 31 of the indoor unit 3. The indoor fan 52 takes indoor air through an intake port 36 of a decorative panel 35 into the casing 30 and, after causing the indoor air to pass through the indoor heat exchanger 51, forms an airflow (indicated by arrows in FIG. 4) that blows out to the outside of the casing 30 through a blow-out port 37 of the decorative panel 35. The indoor air thus supplied by the indoor fan 52 exchanges heat with the refrigerant of the indoor heat exchanger 51, and the temperature of the indoor air is thereby controlled.

The casing 30 includes, mainly, the casing body 31 and the decorative panel 35.

The casing body 31 is installed to be inserted into an opening formed in a ceiling U of an air-conditioned room. In plan view, the casing body 31 is a substantially octagonal box-shaped body formed by alternately connected long sides and short sides. The lower side of the casing body 31 is open. The casing body 31 includes a top panel 61, first side plates 62, second side plates 63, and a connection side plate 64. The first side plates 62 extend downward from portions that constitute long sides at an edge of the top panel 61 in plan view. The second side plates 63 extend downward from three of four portions that constitute short sides at the edge of the top panel 61 in plan view. The connection side plate 64 extends downward from one remaining portion that constitutes a short side at the edge of the top panel 61 in plan view. The connection side plate 64 has an opening 64*a*. The liquid-side connection pipe 53 and the gas-side connection pipe 54 connected to the indoor heat exchanger 51 extend to the outside from the inside of the casing 30 of the indoor unit 3 through the opening 64*a* of the connection side plate 64.

The decorative panel 35 is disposed to be fitted into the opening of the ceiling U and extends outward more than the top panel 61, the first side plates 62, the second side plates 63, and the connection side plate 64 of the casing body 31 in plan view. The decorative panel 35 is mounted below the casing body 31 from the indoor side. The decorative panel 35 includes an inner frame 35*a* and an outer frame 35*b*. On the inner side of the inner frame 35*a*, the substantially quadrangular intake port 36 that opens downward is formed. A filter 34 for removing dust in air taken through the intake port 36 is provided above the intake port 36. On the inner side of the outer frame 35*b* and on the outer side of the inner frame 35*a*, the blow-out port 37 and a corner blow-out port 38 that open downward or obliquely downward are formed. The blow-out port 37 includes a first blow-out port 37*a*, a second blow-out port 37*b*, a third blow-out port 37*c*, and a fourth blow-out port 37*d* at positions corresponding to the sides of the substantially quadrangular shape of the decorative panel 35 in plan view. The corner blow-out port 38 includes a first corner blow-out port 38*a*, a second corner blow-out port 38*b*, a third corner blow-out port 38*c*, and a fourth corner blow-out port 38*d* at positions corresponding to the four corners of the substantially quadrangular shape of the decorative panel 35 in plan view.

The flap 39 is a member capable of changing a direction of an airflow that passes through the blow-out port 37. The flap 39 includes a first flap 39*a* disposed in the first blow-out port 37*a*, a second flap 39*b* disposed in the second blow-out port 37*b*, a third flap 39*c* disposed in the third blow-out port 37*c*, and a fourth flap 39*d* disposed in the fourth blow-out port 37*d*. Each of the flaps 39*a* to 39*d* is rotatably supported at a predetermined position in the casing 30.

The drain pan 32 is disposed on the lower side of the indoor heat exchanger 51 and receives drain water that is generated as a result of moisture in air condensing in the indoor heat exchanger 51. The drain pan 32 is mounted in a lower portion of the casing body 31. In plan view, the drain pan 32 has a cylindrical part extending in the up-down direction on the inner side of the indoor heat exchanger 51. The bell mouth 33 is disposed on an inner lower side of the cylindrical part. The bell mouth 33 guides the air that is taken in through the intake port 36 to the indoor fan 52. In plan view, the drain pan 32 has a plurality of blow-out flow channels 47*a* to 47*d* and corner blow-out flow channels 48*a* to 48*c* that extend in the up-down direction on the outer side of the indoor heat exchanger 51. The blow-out flow channels 47*a* to 47*d* include a first blow-out flow channel 47*a* in communication at the lower end thereof with the first blow-out port 37*a*, a second blow-out flow channel 47*b* in communication at the lower end thereof with the second blow-out port 37*b*, a third blow-out flow channel 47*c* in communication at the lower end thereof with the third blow-out port 37*c*, and a fourth blow-out flow channel 47*d* in communication at the lower end thereof with the fourth blow-out port 37*d*. The corner blow-out flow channels 48*a* to 48*c* include a first corner blow-out flow channel 48*a* in communication at the lower end thereof with the first corner blow-out port 38*a*, a second corner blow-out flow channel 48*b* in communication at the lower end thereof with the second corner blow-out port 38*b*, and a third corner blow-out flow channel 48*c* in communication at the lower end thereof with the third corner blow-out port 38*c*.

The indoor control unit 58 is electrically connected to various sensors and the like disposed in the indoor unit 3. On the basis of information from these sensors and the like, the indoor control unit 58 performs drive control and the like of the indoor fan 52 and transmission and the like of information to an outdoor control unit (not illustrated). The indoor control unit 58 is disposed below the drain pan 32 to be on the inner side of the indoor heat exchanger 51 in plan view.

The refrigerant leakage sensor 59 is a sensor that detects a leakage when a refrigerant leaks in the indoor unit 3 and at the periphery thereof. The refrigerant leakage sensor 59 is electrically connected to the indoor control unit 58 by a transmission line (not illustrated). As the refrigerant leakage sensor 59, a publicly known refrigerant sensor, for example, a semiconductor gas sensor, a hot wire-type semiconductor gas sensor, or the like is usable but is not limited thereto. The refrigerant leakage sensor 59 is disposed inside the casing 30 of the indoor unit 3. Specifically, in order to be able to detect not only a refrigerant that leaks from a welded portion between the flow divider and the plurality of capillary tubes, a welded portion between the plurality of capillary tubes and the plurality of heat transfer pipes 51*c*, a welded portion between the liquid-side connection pipe 53 and the flow divider, a welded portion between the gas-side header 51*d* and the plurality of heat transfer pipes 51*c*, and a connected portion between the gas-side header 51*d* and the gas-side connection pipe 54 in the indoor heat exchanger 51 but also a refrigerant that leaks from a connected portion between the liquid-side connection pipe 53 and the liquid-side refrigerant connection pipe 4 and a connected portion between the gas-side connection pipe 54 and the gas-side refrigerant connection pipe 5 outside the casing 30, which will be described later, the refrigerant leakage sensor 59 is disposed at a position lower than these portions where leakage may occur. For example, the refrigerant leakage sensor 59 may be installed next to the indoor control unit 58 below the drain pan 32, may be placed above the drain pan 32, or may be disposed at an optionally selected place at an intermediate portion of a path from the intake port 36 to the blow-out port 37. In one or more embodiments, the refrigerant leakage sensor 59 is disposed inside the casing 30 to be at a position lower than the above-described portions where a leakage may occur while being on a side opposite to the side of the opening 64*a* of the connection side plate 64 of the casing 30 with respect to an end portion of a communication passage 91 in the casing 30, the communication passage 91 being formed in an indoor-side dew condensation prevention member 71, which will be described later. The refrigerant leakage sensor 59 may be disposed at a position lower than the above-described portions where a leakage may occur while being disposed between the above-described portions where a leakage may occur and the end portion of the communication passage 91 in the casing 30, the communication passage 91 being formed in the indoor-side dew condensation prevention member 71.

A sensor that detects a leaked refrigerant is not provided on the outer side of the casing 30 of the indoor unit 3.

Figure 6:
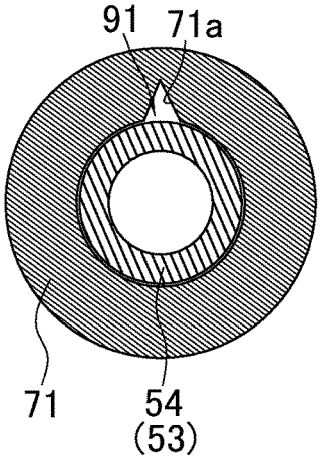
FIG. 6 is a sectional view in which the B-B section in FIG. 5 is viewed in an axial direction of the gas-side connection pipe 54 (liquid-side connection pipe 53).

(4) Connection of Indoor Unit to Liquid-side Refrigerant Connection Pipe and Gas-side Refrigerant Connection Pipe A schematic configurational side view illustrating a state in which the liquid-side connection pipe 53 and the gas-side connection pipe 54 passing through the opening 64*a* of the connection side plate 64 of the casing 30 are connected to the liquid-side refrigerant connection pipe 4 and the gas-side refrigerant connection pipe 5 is illustrated in FIG. 5. In FIG. 5, movement paths of a refrigerant from when the refrigerant leaks at parts indicated by cloud like shapes to when the leaked refrigerant is detected by the refrigerant leakage sensor are indicated by one dot chain lines. In FIG. 6, the B-B section in FIG. 5 as viewed in the axial direction of the gas-side connection pipe 54 (liquid-side connection pipe 53) is illustrated.

The indoor unit 3 is connected to the gas-side refrigerant connection pipe 5 via the gas-side connection pipe 54 and connected to the liquid-side refrigerant connection pipe 4 via the liquid-side connection pipe 53.

The gas-side connection pipe 54 is connected at one end thereof to, of the indoor heat exchanger 51, the gas-side header 51*d*. The other end of the gas-side connection pipe 54 extends out to the outside of the casing 30 of the indoor unit 3 and is flare-connected outside the casing 30 of the indoor unit 3 to the gas-side refrigerant connection pipe 5. Specifically, the gas-side connection pipe 54 is mounted with a joint body 75 at an end portion positioned on the outer side of the casing 30. An end portion of the gas-side refrigerant connection pipe 5 on a side connected to the gas-side connection pipe 54 is provided with a flare nut 76. Consequently, the gas-side connection pipe 54 and the gas-side refrigerant connection pipe 5 are fastened and fixed by the flare nut 76 being fastened in a state in which a tip of the gas-side refrigerant connection pipe 5 is in contact with the joint body 75 mounted to the gas-side connection pipe 54.

A radially outside part of the gas-side connection pipe 54 in one or more embodiments is provided with the indoor-side dew condensation prevention member 71 for suppressing occurrence of dew condensation during operations. The indoor-side dew condensation prevention member 71 is a non-metal and is a cylindrical foam body constituted by a resin or the like. The indoor-side dew condensation prevention member 71 has heat insulation properties. In one or more embodiments, the indoor-side dew condensation prevention member 71 not only covers the outside of the gas-side connection pipe 54 in the radial direction but also extends to a side opposite to the side of the casing 30. The indoor-side dew condensation prevention member 71 is able to cover the flare nut 76 and the periphery of a portion of the gas-side refrigerant connection pipe 5 in the vicinity of the flare nut 76 in a state in which the gas-side connection pipe 54 and the gas-side refrigerant connection pipe 5 are connected to each other. Similarly, the radially outside part of the gas-side refrigerant connection pipe 5 is also provided with a connection-side dew condensation prevention member 72 for suppressing occurrence of dew condensation during operations. The connection-side dew condensation prevention member 72 is also a non-metal and is a cylindrical foam body constituted by a resin or the like. The connection-side dew condensation prevention member 72 also has heat insulation properties. In one or more embodiments, the connection-side dew condensation prevention member 72 is provided to cover, of the gas-side refrigerant connection pipe 5, the radially outer side of a part extending to a portion before the flare nut 76.

In a state before the indoor unit 3 is constructed at a local site, the gas-side connection pipe 54 and the joint body 75 extending out through the opening 64*a* of the connection side plate 64 of the casing 30 are in a state of being covered by the indoor-side dew condensation prevention member 71. The indoor-side dew condensation prevention member 71 is fixed in the casing 30 to the gas-side connection pipe 54 by being fastened by a first tie wrap 81 from radially outside of the indoor-side dew condensation prevention member 71.

In construction, the gas-side connection pipe 54 and the joint body 75 are connected to the gas-side refrigerant connection pipe 5 and the flare nut 76 covered by the connection-side dew condensation prevention member 72. In one or more embodiments, of the indoor-side dew condensation prevention member 71, a portion extending more than the gas-side connection pipe 54 and the joint body 75 is mounted to further cover, from the radially outer side, the connection-side dew condensation prevention member 72 covering the gas-side refrigerant connection pipe 5 and the flare nut 76. The indoor-side dew condensation prevention member 71 covering the outer side of the connection-side dew condensation prevention member 72 is fastened by a second tie wrap 82 from the radially outer side to thereby fix the connection-side dew condensation prevention member 72 and the indoor-side dew condensation prevention member 71 to each other.

As illustrated in FIG. 6, on the radially inner side of the indoor-side dew condensation prevention member 71, a notch portion 71*a* formed such that a part notched toward the radially outer side is continuous in the axial direction is provided. Due to the notch portion 71*a* provided at the inner peripheral part of the indoor-side dew condensation prevention member 71, the communication passage 91, which is a space formed by the inner peripheral surface of the indoor-side dew condensation prevention member 71 and the outer peripheral surface of the gas-side connection pipe 54 being positioned away from each other in the radial direction, is formed. The communication passage 91 extends in the axial direction of the gas-side connection pipe 54 to the inside of the casing 30 through the opening 64*a* of the connection side plate 64 of the casing 30. An end portion of the communication passage 91 on the inner side of the casing 30 is open toward the space in the casing 30.

Connection between the liquid-side connection pipe 53 and the liquid-side refrigerant connection pipe 4 is the same as the aforementioned connection between the gas-side connection pipe 54 and the gas-side refrigerant connection pipe 5, and thus, description thereof is omitted.

(5) Features of Embodiments described above

The refrigerant leakage sensor 59 is provided inside the casing 30 of the indoor unit 3. Thus, even when a refrigerant leaks from a portion inside the casing 30, such as the indoor heat exchanger 51, the liquid-side connection pipe 53, the gas-side connection pipe 54 in the casing 30, and the connected portions thereof, the leakage can be detected by the refrigerant leakage sensor 59.

The indoor unit 3 is constructed as a result of the liquid-side connection pipe 53 and the gas-side connection pipe 54 that extend to the outside of the casing 30 from the indoor heat exchanger 51 being connected to the liquid-side refrigerant connection pipe 4 and the gas-side refrigerant connection pipe 5, respectively. Therefore, a connected portion between the refrigerant pipes is also generated outside the casing 30 of the indoor unit 3, and a refrigerant may leak from the connected portion.

In the indoor unit 3 according to the embodiments described above, the communication passage 91, which is a space between the inner peripheral surface of the indoor-side dew condensation prevention member 71 and the outer peripheral surface of the liquid-side connection pipe 53, is formed due to the notch portion 71*a* provided at the inner peripheral part of the indoor-side dew condensation prevention member 71. Therefore, both of the space in which the connected portion between the liquid-side connection pipe 53 and the liquid-side refrigerant connection pipe 4 is covered by the indoor-side dew condensation prevention member 71 and the space in which the connected portion between the gas-side connection pipe 54 and the gas-side refrigerant connection pipe 5 is covered by the indoor-side dew condensation prevention member 71 are in a state of being in communication with the internal space of the casing 30 of the indoor unit 3 via each communication passage 91.

A leaked refrigerant is thus guided (refer to the one dot chain lines in FIG. 5) to the internal space of the casing 30 of the indoor unit 3 via each communication passage 91, even when the refrigerant leaks from the connected portion between the liquid-side connection pipe 53 and the liquid-side refrigerant connection pipe 4 or from the connected portion between the gas-side connection pipe 54 and the gas-side refrigerant connection pipe 5. Thus, a refrigerant leakage that occurs outside the casing 30 can be detected by the refrigerant leakage sensor 59 disposed in the internal space of the casing 30.

In the embodiments described above, since no sensor for detecting a refrigerant leakage is provided outside the casing 30 of the indoor unit 3, it is possible without increasing the number of leakage detection sensors to detect a refrigerant leakage that occurs outside the casing 30.

(6) Modifications (6-1) Modification A

The aforementioned embodiments have been described by presenting, as an example, a case in which the communication passage 91 is formed by providing the notch portion 71*a* in the indoor-side dew condensation prevention member 71.

Figure 7:
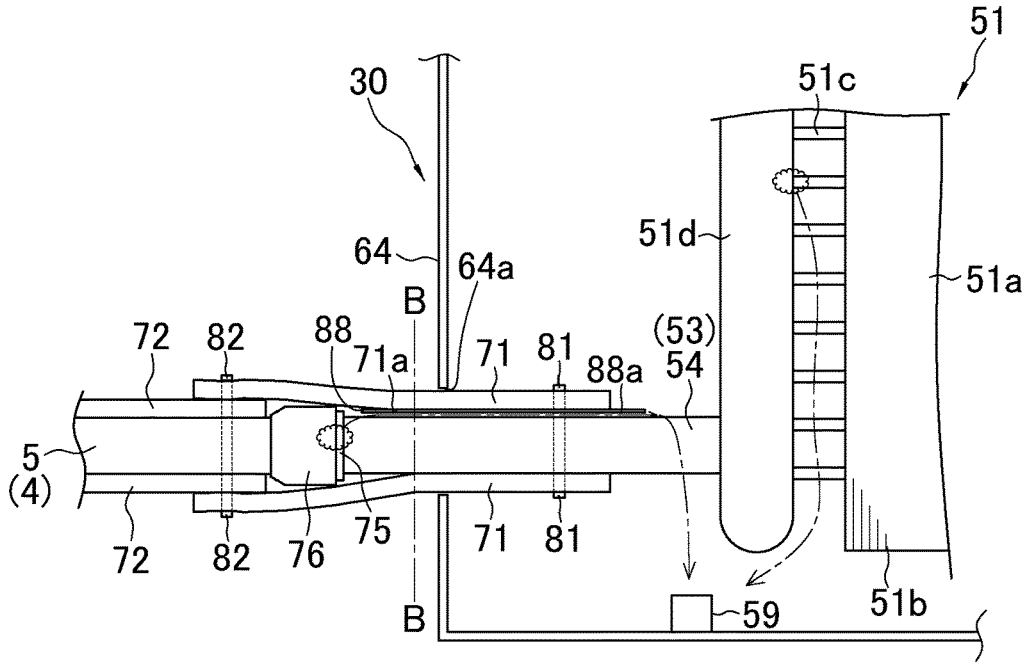
FIG. 7 is a schematic configurational side view illustrating connection between the gas-side connection pipe 54 (liquid-side connection pipe 53) and the gas-side refrigerant connection pipe 5 (liquid-side refrigerant connection pipe 4) in Modification A.
Figure 8:
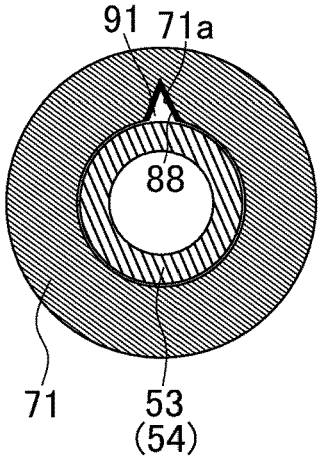
FIG. 8 is a sectional view in which the B-B section in FIG. 7 is viewed in an axial direction of the gas-side connection pipe 54 (liquid-side connection pipe 53).

Alternatively, in the indoor unit 3, for example, as illustrated in FIG. 7 and FIG. 8, a communication-passage formation member 88 (communication-passage spacer) that is a separate member for reinforcing the notch portion 71*a* formed in the indoor-side dew condensation prevention member 71 may be additionally used.

The shape of the communication-passage formation member 88 is not limited. For example, in terms of being able to reliably perform reinforcement, the communication-passage formation member 88 may have a shape corresponding to the shape of the notch portion 71*a* formed in the indoor-side dew condensation prevention member 71. An end portion of the communication-passage formation member 88 in the casing 30 may extend, more than an end portion of the indoor-side dew condensation prevention member 71 in the casing 30, toward a side away from the opening 64*a* of the connection side plate 64 and may have an extension part 88*a* extending to approach the refrigerant leakage sensor 59. Due to the communication-passage formation member 88 thus including the extension part 88*a*, a leaked refrigerant is easily guided to the vicinity of the refrigerant leakage sensor 59 when a refrigerant leakage occurs in, for example, a space in which the connected portion between the liquid-side connection pipe 53 and the liquid-side refrigerant connection pipe 4 is covered by the indoor-side dew condensation prevention member 71.

When the communication-passage formation member 88 that is a separate member from the indoor-side dew condensation prevention member 71 is thus used, the communication-passage formation member 88 may be bonded and fixed to the indoor-side dew condensation prevention member 71 or may be bonded and fixed to the liquid-side connection pipe 53 or the gas-side connection pipe 54 to be suppressed from coming off.

To suppress occurrence of dew condensation on a surface of the communication-passage formation member 88 itself, the communication-passage formation member 88 may be constituted by a non-metal, such as a resin.

In addition, the communication-passage formation member 88, which is a separate member from the indoor-side dew condensation prevention member 71, may be less deformable than the indoor-side dew condensation prevention member 71. Consequently, even when being fastened and fixed by the first tie wrap 81, the communication passage 91 is suppressed from being narrowed at a portion that is tied by the first tie wrap 81, which makes it possible to reliably ensure the communication state of the communication passage 91.

(6-2) Modification B

The aforementioned embodiments have been described by presenting, as an example, a case in which the communication passage 91 is formed by providing the notch portion 71*a* in the indoor-side dew condensation prevention member 71.

Figure 9:
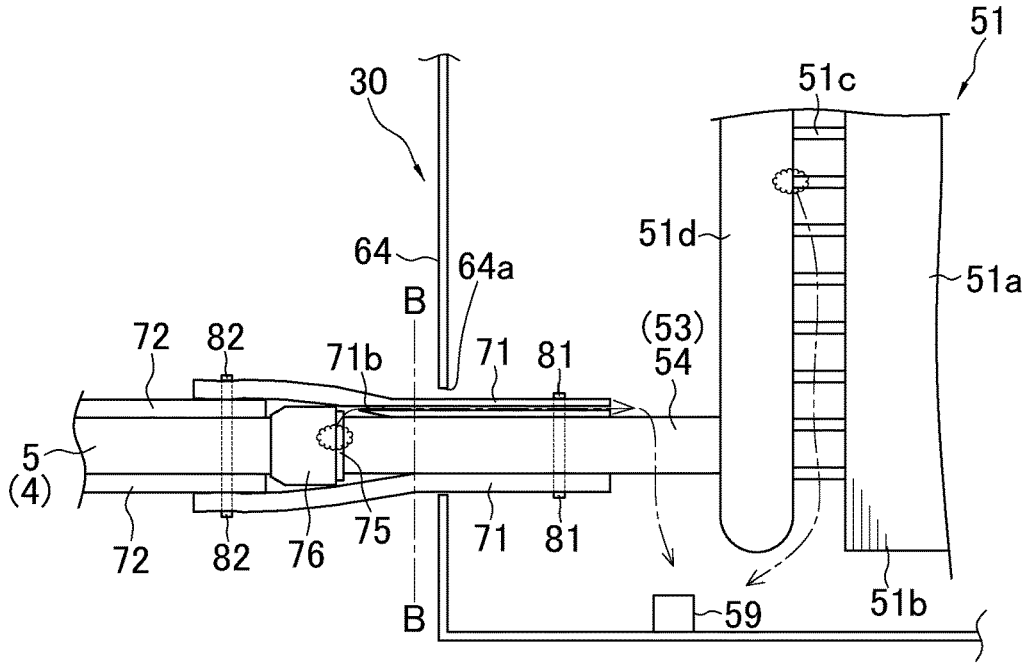
FIG. 9 is a schematic configurational side view illustrating connection between the gas-side connection pipe 54 (liquid-side connection pipe 53) and the gas-side refrigerant connection pipe 5 (liquid-side refrigerant connection pipe 4) in Modification B.
Figure 10:
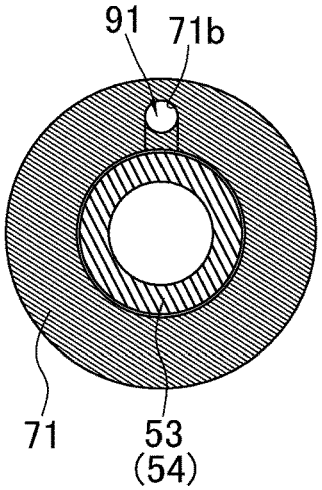
FIG. 10 is a sectional view in which the B-B section in FIG. 9 is viewed in an axial direction of the gas-side connection pipe 54 (liquid-side connection pipe 53).

Alternatively, in the indoor unit 3, for example, as illustrated in FIG. 9 and FIG. 10, the indoor-side dew condensation prevention member 71 may include a hollow portion 71*b*. The hollow portion 71*b* is formed by hollowing out a portion of the indoor-side dew condensation prevention member 71 such that spaces in the vicinity of the connected portion between the liquid-side connection pipe 53 and the liquid-side refrigerant connection pipe 4 and in the vicinity of the connected portion between the gas-side connection pipe 54 and the gas-side refrigerant connection pipe 5 are in communication with the internal space of the casing 30 via a thickness part (the part between the outer peripheral surface and the inner peripheral surface) of the indoor-side dew condensation prevention member 71.

Even in this case, a refrigerant that leaks at the connected portion between the liquid-side connection pipe 53 and the liquid-side refrigerant connection pipe 4 and the connected portion between the gas-side connection pipe 54 and the gas-side refrigerant connection pipe 5 can be detected through the communication passage 91 constituting the inner side of the hollow portion 71*b* by the refrigerant leakage sensor 59 in the casing 30.

(6-3) Modification C

Modification B mentioned above has been described by presenting, as an example, a case in which the hollow portion 71*b* is provided in the indoor-side dew condensation prevention member 71 to form the communication passage 91.

Figure 11:
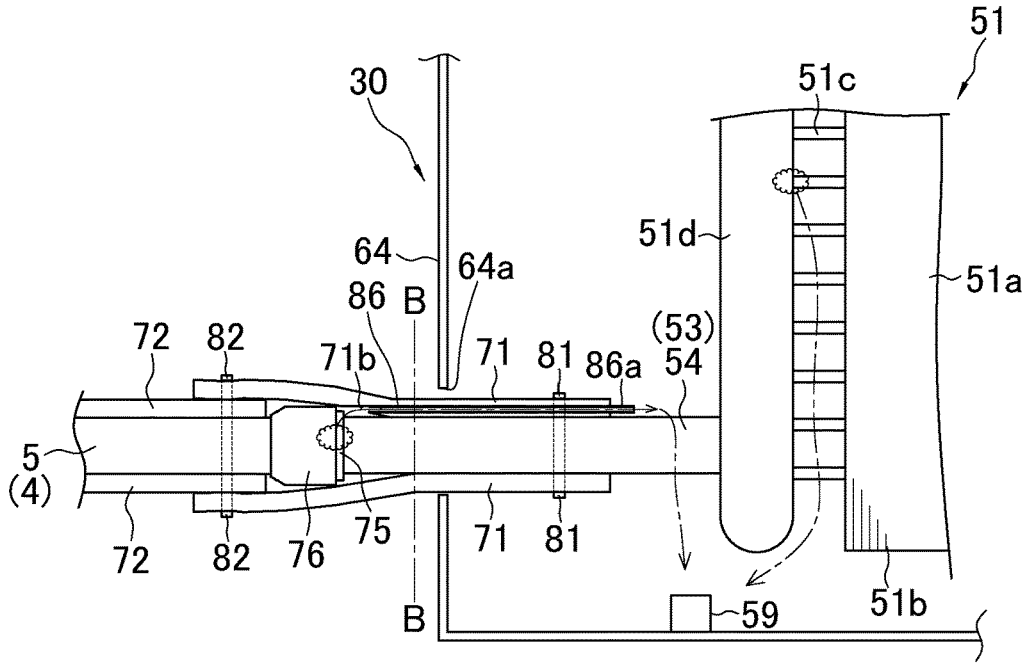
FIG. 11 is a schematic configurational side view illustrating connection between the liquid-side connection pipe 53 (gas-side connection pipe 54) and the liquid-side refrigerant connection pipe 4 (gas-side refrigerant connection pipe 5) in Modification C.
Figure 12:
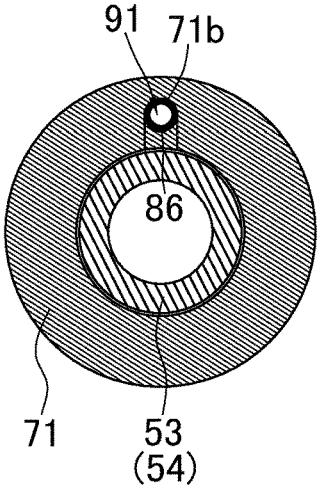
FIG. 12 is a sectional view in which the B-B section in FIG. 11 is viewed in an axial direction of the liquid-side connection pipe 53 (gas-side connection pipe 54).

Alternatively, in the indoor unit 3, for example, as illustrated in FIG. 11 and FIG. 12, a pipe 86 may be provided on the inner side of the hollow portion 71*b* to increase the strength of the hollow portion 71*b* of the indoor-side dew condensation prevention member 71. An end portion of the pipe 86 in the casing 30 may extend more than the end portion of the indoor-side dew condensation prevention member 71 in the casing 30 toward the side away from the opening 64*a* of the connection side plate 64 and may include an extension part 86*a* extending to approach the refrigerant leakage sensor 59. Due to the pipe 86 thus including the extension part 86*a*, a leaked refrigerant is easily guided to the vicinity of the refrigerant leakage sensor 59 when a refrigerant leakage occurs in, for example, a space in which the connected portion between the liquid-side connection pipe 53 and the liquid-side refrigerant connection pipe 4 is covered by the indoor-side dew condensation prevention member 71.

The pipe 86 may be made of a non-metal, such as a resin, to suppress occurrence of dew condensation on a surface of the pipe 86 itself.

The pipe 86, which is a separate member from the indoor-side dew condensation prevention member 71, may be less deformable than the indoor-side dew condensation prevention member 71. Consequently, even when being fastened and fixed by the first tie wrap 81, the communication passage 91 is suppressed from being narrowed at a portion that is tied by the first tie wrap 81, which makes it possible to reliably ensure the communication state of the communication passage 91.

(6-4) Modification D

Modification C mentioned above has been described by presenting, as an example, a case in which the pipe 86 is embedded in the hollow portion 71*b* formed inside the indoor-side dew condensation prevention member 71 to thereby ensure the communication passage 91.

Figure 13:
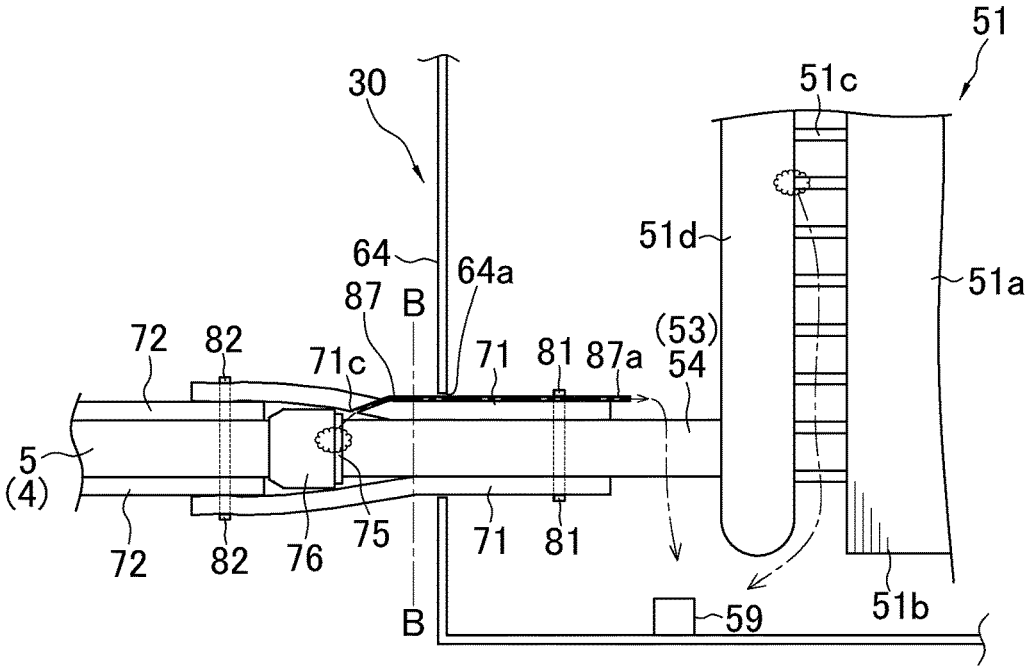
FIG. 13 is a schematic configurational side view illustrating connection between the liquid-side connection pipe 53 (gas-side connection pipe 54) and the liquid-side refrigerant connection pipe 4 (gas-side refrigerant connection pipe 5) in Modification D.
Figure 14:
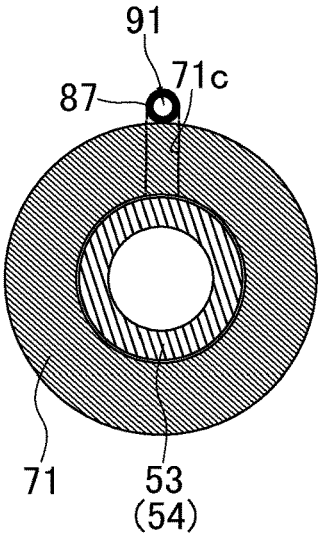
FIG. 14 is a sectional view in which the B-B section in FIG. 13 is viewed in an axial direction of the liquid-side connection pipe 53 (gas-side connection pipe 54).

Alternatively, in the indoor unit 3, for example, as illustrated in FIG. 13 and FIG. 14, the indoor-side dew condensation prevention member 71 may include a through portion 71*c*, and a pipe 87 may be provided to extend to the internal space of the casing 30 through the through portion 71*c*.

The through portion 71*c* of the indoor-side dew condensation prevention member 71 is formed to pass through a portion of the indoor-side dew condensation prevention member 71 so that spaces in the vicinity of the connected portion between the liquid-side connection pipe 53 and the liquid-side refrigerant connection pipe 4 and in the vicinity of the connected portion between the gas-side connection pipe 54 and the gas-side refrigerant connection pipe 5 are in communication with a space on the radially outer side of the indoor-side dew condensation prevention member 71.

The pipe 87 extends from the spaces in the vicinity of the connected portion between the liquid-side connection pipe 53 and the liquid-side refrigerant connection pipe 4 and in the vicinity of the connected portion between the gas-side connection pipe 54 and the gas-side refrigerant connection pipe 5 to the radially outer side of the indoor-side dew condensation prevention member 71 via the through portion 71*c* of the indoor-side dew condensation prevention member 71 and then extends along the indoor-side dew condensation prevention member 71 to the internal space of the casing 30.

Even in this case, a refrigerant that leaks at the connected portion between the liquid-side connection pipe 53 and the liquid-side refrigerant connection pipe 4 and the connected portion between the gas-side connection pipe 54 and the gas-side refrigerant connection pipe 5 can be detected through the communication passage 91 constituting the internal space of the pipe 87 by the refrigerant leakage sensor 59 in the casing 30.

An end portion of the pipe 87 in the casing 30 may extend more than the end portion of the indoor-side dew condensation prevention member 71 in the casing 30 toward the side away from the opening 64*a* of the connection side plate 64 and may include an extension part 87*a* extending to approach the refrigerant leakage sensor 59. Due to the pipe 87 thus including the extension part 87*a*, a leaked refrigerant is easily guided to the vicinity of the refrigerant leakage sensor 59 when a refrigerant leakage occurs in, for example, a space in which the connected portion between the liquid-side connection pipe 53 and the liquid-side refrigerant connection pipe 4 is covered by the indoor-side dew condensation prevention member 71.

The pipe 87 may be made of a non-metal, such as a resin, to suppress occurrence of dew condensation on a surface of the pipe 87 itself.

The pipe 87, which is a separate member from the indoor-side dew condensation prevention member 71, may be less deformable than the indoor-side dew condensation prevention member 71. Consequently, even when being fastened and fixed by the first tie wrap 81, the communication passage 91 is suppressed from being narrowed at a portion that is tied by the first tie wrap 81, which makes it possible to reliably ensure the communication state of the communication passage 91.

(6-5) Modification E

Modifications C and D mentioned above have been described by presenting, as an example, the indoor unit 3 including the pipe 86 or 87.

Figure 15:
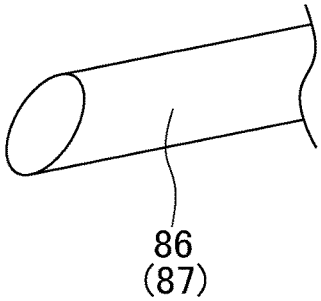
FIG. 15 is a schematic external view illustrating a shape of an end portion of a pipe in Modification E.

As illustrated in FIG. 15, each of the pipe 86 and pipe 87 may be configured to have an obliquely cut end portion. Specifically, an end portion of each of the pipe 86 and the pipe 87 may be configured to have a surface having a normal direction in the axial direction of the pipe 86 or 87, and the surface may be cut by a surface not parallel thereto. From the point of view of easily suppressing blockage of the end portion of each of the pipe 86 and the pipe 87 with dust and the like, the pipe 86 and the pipe 87 may each be used in an orientation in which an opening of the end portion is directed obliquely downward.

(6-6) Modification F

The aforementioned embodiments have been described by presenting, as an example, a case in which a state of the dew condensation prevention members being continuous is ensured such that an end portion of the indoor-side dew condensation prevention member 71 covers an end portion of the connection-side dew condensation prevention member 72 from the radially outer side.

Figure 16:
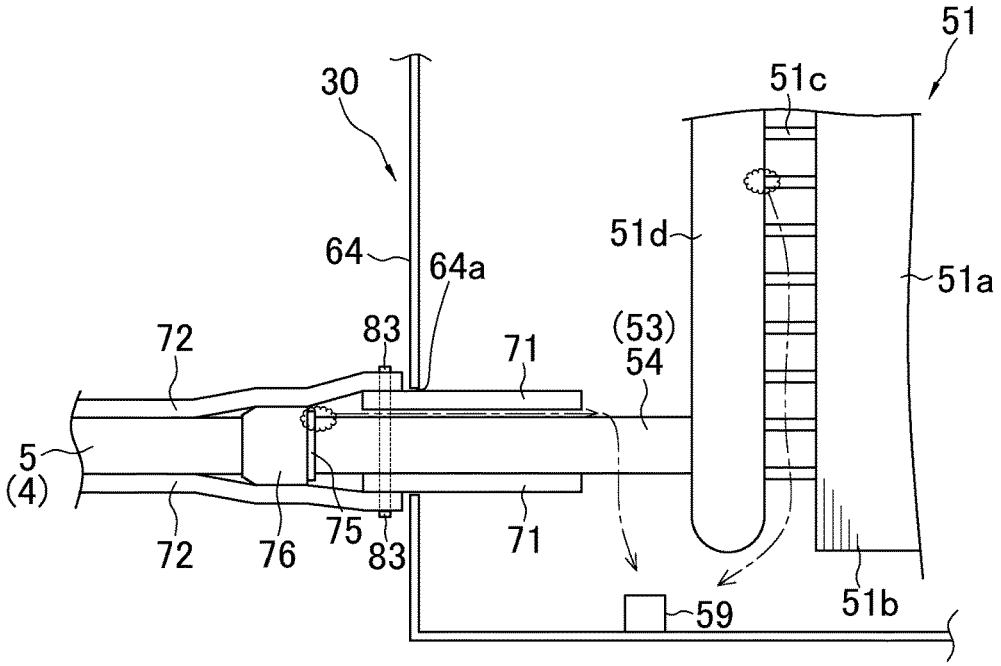
FIG. 16 is a schematic configurational side view illustrating connection between the liquid-side connection pipe 53 (gas-side connection pipe 54) and the liquid-side refrigerant connection pipe 4 (gas-side refrigerant connection pipe 5) in Modification F.

Alternatively, for example, as illustrated in FIG. 16, when the indoor-side dew condensation prevention member 71 is provided to extend to a portion before the joint body 75 with the connection-side dew condensation prevention member 72 being provided to extend beyond the flare nut 76 and the joint body 75 to the side of the casing 30, a state of the dew condensation prevention members being continuous may be ensured such that an end portion of the connection-side dew condensation prevention member 72 covers an end portion of the indoor-side dew condensation prevention member 71 from the radially outer side. In this case, the connection-side dew condensation prevention member 72 and the indoor-side dew condensation prevention member 71 are fixed to each other as a result of the connection-side dew condensation prevention member 72 that covers the outer side of the indoor-side dew condensation prevention member 71 being fastened from the radially outer side by a third tie wrap 83.

Even in this case, a form of each of the aforementioned embodiments and each of the modifications is applicable to a manner of ensuring the communication passage 91.

(6-7) Modification G

The aforementioned embodiments have been described by presenting, as an example, a case in which a state of the dew condensation prevention members being continuous is ensured such that an end portion of the indoor-side dew condensation prevention member 71 covers an end portion of the connection-side dew condensation prevention member 72 from the radially outer side.

Figure 17:
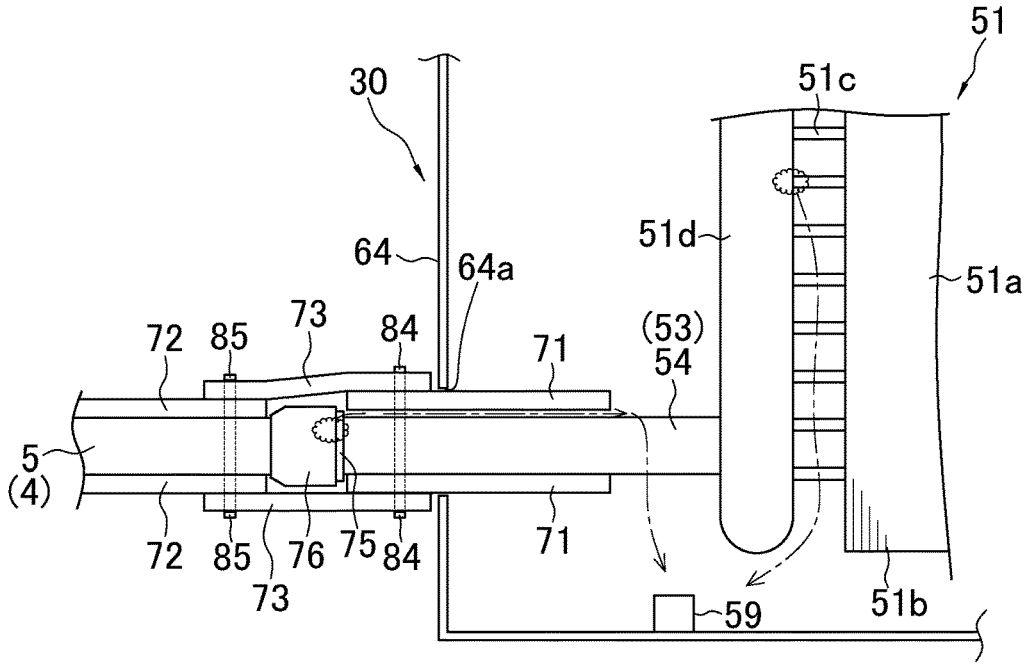
FIG. 17 is a schematic configurational side view illustrating connection between the liquid-side connection pipe 53 (gas-side connection pipe 54) and the liquid-side refrigerant connection pipe 4 (gas-side refrigerant connection pipe 5) in Modification G.

Alternatively, for example, as illustrated in FIG. 17, when the indoor-side dew condensation prevention member 71 is provided to extend to a portion before the joint body 75 with the connection-side dew condensation prevention member 72 also being provided to extend to a portion before the flare nut 76, the outer side parts of the joint body 75 and the flare nut 76 may be covered by an additional dew condensation prevention member 73 to thereby ensure the continuous state of the dew condensation prevention members by the indoor-side dew condensation prevention member 71, the connection-side dew condensation prevention member 72, and the additional dew condensation prevention member 73. In this case, of the additional dew condensation prevention member 73, a part that covers the outer side of the indoor-side dew condensation prevention member 71 is fastened from the radially outside by a fourth tie wrap 84 with, of the additional dew condensation prevention member 73, a part that covers the outer side of the connection-side dew condensation prevention member 72 being fastened from the radially outer side by a fifth tie wrap 85, thereby fixing the indoor-side dew condensation prevention member 71, the connection-side dew condensation prevention member 72, and the additional dew condensation prevention member 73 to each other.

Even in this case, a form of each of the aforementioned embodiments and each of the modifications is applicable to a manner of ensuring the communication passage 91.

(6-8) Modification H

The aforementioned embodiments have been described by presenting, as an example, a case in which the refrigerant leakage sensor 59 is provided in the internal space of the casing 30 of the indoor unit 3.

Alternatively, no refrigerant leakage sensor may be provided in the indoor unit 3 itself. For example, when checking presence/absence of a refrigerant leakage by a refrigerant leakage sensor carried by a service engineer or the like, it is possible, due to a leaked refrigerant flowing in the communication passage 91, to detect the leakage of the refrigerant from a connected portion of refrigerant pipes outside the casing 30 by only performing checking with respect to the internal space of the casing 30 of the indoor unit 3 without performing checking with respect to the external space of the casing 30 in an attic or the like.

(6-9) Modification I

The aforementioned embodiments have been described by presenting, as an example, a case in which the indoor unit 3 includes a configuration for detecting, inside the casing 30, a refrigerant leakage that occurs outside the casing 30 of the indoor unit 3.

A unit to be provided with the configuration is not limited. For example, the outdoor unit 2 may include a configuration for detecting, inside the casing of the outdoor unit 2, a refrigerant leakage that occurs outside the casing of the outdoor unit 2.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 air conditioning apparatus
3 indoor unit (air conditioning apparatus)
4 liquid-side refrigerant connection pipe (a pipe connected to a refrigerant pipe)
5 gas-side refrigerant connection pipe (a pipe connected to a refrigerant pipe)
30 casing
51 indoor heat exchanger (heat exchanger)
53 liquid-side connection pipe (refrigerant pipe)
54 gas-side connection pipe (refrigerant pipe)
59 refrigerant leakage sensor
64 connection side plate
64*a* opening (pipe opening)
71 indoor-side dew condensation prevention member (first dew condensation prevention member)
72 connection-side dew condensation prevention member (second dew condensation prevention member)
73 connection-side dew condensation prevention member (second dew condensation prevention member)
75 joint body (pipe-connection end portion)
81 first tie wrap (inside fastening member)
82 second tie wrap (outside fastening member)
86 pipe
87 pipe
88 communication-passage formation member
91 communication passage

PATENT LITERATURE

PTL 1: Japanese Unexamined Patent Application Publication No. 2016-197006

The invention claimed is:

1. An air conditioning apparatus comprising:
a casing that has a pipe opening;
a heat exchanger in the casing;
a refrigerant pipe that comprises a pipe-connection end portion disposed outside the casing;
a first dew condensation prevention cover that is cylindrical and that peripherally covers at least a part of the refrigerant pipe that passes through the pipe opening, wherein the refrigerant pipe is covered by either the first dew condensation prevention cover or a second dew condensation prevention cover that differs from the first dew condensation prevention cover;
a refrigerant leakage sensor disposed in an internal space of the casing and that detects leaked refrigerant; and
a communication passage that communicates space around the pipe-connection end portion with the internal space of the casing in which the refrigerant leakage sensor is disposed, wherein
the communication passage, the refrigerant pipe, and one of the first dew condensation prevention cover and the second dew condensation prevention cover that covers the refrigerant pipe all pass through the pipe opening of the casing.

2. The air conditioning apparatus according to claim 1, wherein the communication passage is disposed:
between the first dew condensation prevention cover and the refrigerant pipe,
in the first dew condensation prevention cover, or
at an outer periphery of the first dew condensation prevention cover.

3. The air conditioning apparatus according to claim 1, wherein the communication passage is constituted by a pipe made of a non-metal.

4. The air conditioning apparatus according to claim 3, wherein a tip of the pipe on a side of the communication passage has an obliquely cut shape.

5. The air conditioning apparatus according to claim 1, further comprising:
a communication-passage spacer that forms the communication passage and that is bonded and fixed to at least one of the refrigerant pipe or the first dew condensation prevention cover.

6. The air conditioning apparatus according to claim 5, further comprising:
an inside fastener that fastens:
the communication-passage spacer;
the refrigerant pipe; and
the first dew condensation prevention cover on a side of the internal space of the casing with respect to the pipe-connection end portion.

7. The air conditioning apparatus according to claim 1, further comprising:
an outside fastener that fastens:
the first dew condensation prevention cover; and
a pipe connected to the pipe-connection end portion and in communication with the refrigerant pipe.

8. The air conditioning apparatus according to claim 1, wherein a sensor that detects a leaked refrigerant is not provided outside the casing.

* * * * *